US008675453B2

(12) United States Patent
Gabathuler et al.

(10) Patent No.: US 8,675,453 B2
(45) Date of Patent: Mar. 18, 2014

(54) BACKLASH-COMPENSATING MECHANISM FOR A TIMEPIECE MOVEMENT

(75) Inventors: Jacques Gabathuler, Chene-Bougeries (CH); Serge Nicollin, Geneva (CH)

(73) Assignee: Breitling AG, Grenchen (CH)

( * ) Notice: Subject to any disclaimer, the term of this patent is extended or adjusted under 35 U.S.C. 154(b) by 466 days.

(21) Appl. No.: 13/182,534

(22) Filed: Jul. 14, 2011

(65) Prior Publication Data

US 2012/0014224 A1 Jan. 19, 2012

(30) Foreign Application Priority Data

Jul. 14, 2010 (EP) ..... 10007238

(51) Int. Cl.
*G04B 19/253* (2006.01)

(52) U.S. Cl.
USPC ..... 368/38; 368/221; 368/28; 368/37

(58) Field of Classification Search
USPC ..... 368/28, 37, 38, 220, 221
See application file for complete search history.

(56) References Cited

U.S. PATENT DOCUMENTS

| | | | | |
|---|---|---|---|---|
| 3,667,211 | A | 6/1972 | Schneider | |
| 4,240,249 | A * | 12/1980 | Malkin et al. | 368/28 |
| 6,744,696 | B2 * | 6/2004 | Vernay et al. | 368/37 |
| 7,158,448 | B1 * | 1/2007 | Gabathuler et al. | 368/37 |
| 7,218,576 | B1 * | 5/2007 | Bron | 368/35 |
| 7,643,379 | B2 * | 1/2010 | Villar et al. | 368/38 |
| 8,040,759 | B2 * | 10/2011 | Chaignat | 368/38 |
| 2002/0080686 | A1 * | 6/2002 | Rochat et al. | 368/37 |
| 2005/0254350 | A1 * | 11/2005 | Fleury | 368/37 |

FOREIGN PATENT DOCUMENTS

| | | | |
|---|---|---|---|
| CH | 473417 | A | 2/1969 |
| CH | 525507 | | 8/1971 |
| DE | 1523864 | | 11/1969 |
| EP | 1335253 | A1 | 8/2003 |
| EP | 1746470 | A1 | 1/2007 |

OTHER PUBLICATIONS

European Search Report, Jan. 26, 2011, in Application No. EP 10007238.

* cited by examiner

*Primary Examiner* — Amy Cohen Johnson
*Assistant Examiner* — Jason Collins
(74) *Attorney, Agent, or Firm* — Young & Thompson

(57) ABSTRACT

A backlash-compensating mechanism includes a cam, an actuating member bearing against the cam and a wheel coaxial to the cam and intended to be driven by a gear train of the movement. The cam and the wheel are connected to each other such that one revolution of the wheel includes a sequence of a first phase in which the wheel drives the cam whilst the co-operation between the cam and the actuating member cocks the latter, a second phase in which the actuating member uncocks and causes the cam to effect an instantaneous jump, and a third phase in which the cam is immobilized and the wheel continues to advance until it catches up with the cam to once again drive it during the first phase of the following revolution. This mechanism includes a resilient element acting between the cam and the wheel and applying a return torque to the wheel during the third phase to compensate the backlash in the gear train.

16 Claims, 4 Drawing Sheets

BACKLASH-COMPENSATING MECHANISM FOR A TIMEPIECE MOVEMENT

The present invention relates to a backlash-compensating mechanism for a timepiece movement.

More particularly, the present invention relates to a backlash-compensating mechanism of the type comprising a cam, an actuating member bearing against the cam and a wheel coaxial to the cam and intended to be driven by a gear train of the movement, the cam and the wheel being connected to each other such that one revolution of the wheel comprises a sequence of a first phase in which the wheel drives the cam whilst the co-operation between the cam and the actuating member cocks the latter, a second phase in which the actuating member causes the cam to effect an instantaneous jump, and a third phase in which the cam is immobilised and the wheel continues to advance until it catches up with the cam to once again drive it during the first phase of the following revolution.

Currently available watches are fitted with such a backlash-compensating mechanism. In these watches the backlash-compensating mechanism is a part of an instantaneous jump date display mechanism. The wheel rotates at one revolution per 24 hours under the action of the time-display gear train of the movement and the cam drives a drive member which itself displaces a date indicator by one step once every 24 hours, at midnight, upon the instantaneous jump of the cam. During the first phase, before this instantaneous jump, the bearing of the actuating member on the cam generates a return torque in the opposite direction to the direction of rotation of the cam and of the wheel, and this torque is transmitted to the wheel and propagates upstream to the cannon pinion of the movement which suppresses the backlash in the time-display gear train. During the third phase, after the instantaneous jump, such a return torque is no longer generated since then the cam is immobilised by the co-operation between the actuating member and a recess of the cam in an angular position located in advance of the wheel and the wheel is free with respect to the cam.

The third phase lasts until the wheel has caught up with the angular position of the cam, i.e., typically several hours. Throughout this time, the backlash in the time-display gear train is not compensated, so that in the case of a shock received by the watch, undesired relative displacements of the hands can occur. Such relative displacements can also occur if hand-setting or time zone correction takes place in the direction in which backlash accumulates. This problem is particularly critical in the case of a watch having several hour hands, e.g., hands of two different time zones rotating at one revolution per 12 hours or an hour hand rotating at one revolution per 12 hours and another hour hand rotating at one revolution per 24 hours, and when a differential is used to allow the correction of one of the hands independently from the other. In this case, in fact, the differential significantly increases the backlash such that large offsets can appear between the hour hands and between each of the these hands and the minute hand, during a shock, hand-setting or correction. These offsets, discernible by the user, are only compensated once the backlash itself has been compensated by the normal operation of the gear train after the shock, hand-setting or correction. This compensation can take several tens of minutes.

The present invention aims to overcome these disadvantages, or at least reduce them, and to this end proposes a backlash-compensating mechanism of the type mentioned above, characterised in that it further comprises resilient means acting between the cam and the wheel and applying a return torque to the wheel during the third phase.

The resilient means can comprise a spring whose ends are fixed relative to the cam and to the wheel respectively.

The spring can be a coil spring coaxial to the cam and to the wheel.

The mechanism in accordance with the invention can also comprise a hub around which the wheel is mounted and relative to which the cam is fixed, and the spring can be located around this hub and have its ends fixed to the hub and to the wheel respectively.

At least one of the ends of the spring can be made fixed relative to the cam, respectively to the wheel, by a hook.

The cam and the wheel can be connected by an eccentric pin fixed to the cam and co-operating with an oblong opening formed in the wheel, in the form of a circular arc centred on the axis of the wheel.

The actuating member can comprise a lever and a spring biasing the lever against the cam.

The present invention also relates to an instantaneous jump display mechanism comprising a backlash-compensating mechanism as defined above, a drive member driven by the cam of the backlash-compensating mechanism and an indicator driven by the drive member.

The drive member can be fixed relative to the cam and can radially protrude from the hub.

The indicator is for example a date indicator.

The present invention also relates to a timepiece movement comprising a backlash-compensating mechanism or an instantaneous jump display mechanism as defined above.

This movement can comprise a time-display gear train which drives the backlash-compensating mechanism, these time-display gear train comprising a differential gear connecting a mobile part having a first hand indicating the hours to another mobile part having another hand indicating the hours.

The present invention also relates to a watch comprising a timepiece movement as defined above.

Other features and advantages of the present invention will become clear upon reading the following detailed description made with reference to the accompanying drawings, in which.

Figure 1:
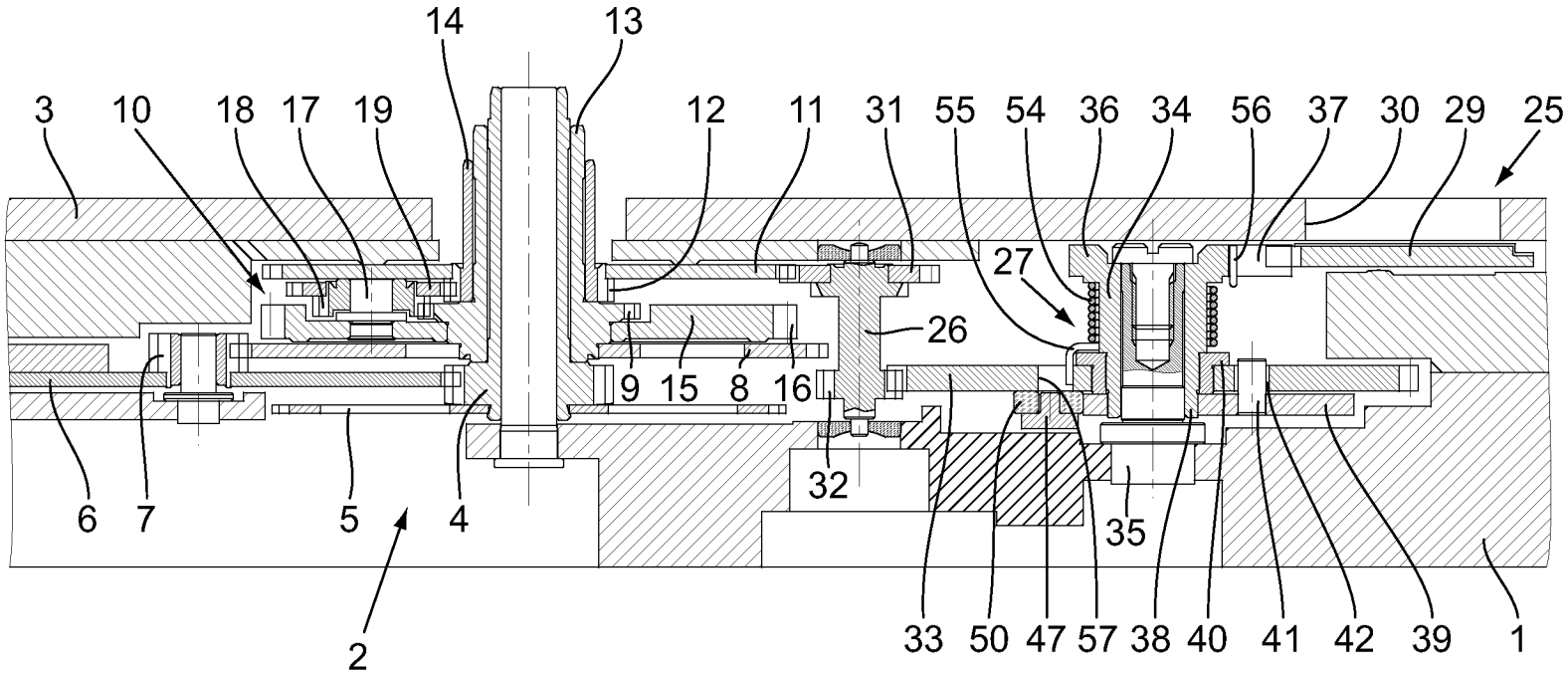
FIG. 1 is a cross-sectional view of part of a timepiece movement in accordance with the invention.

With reference to FIG. 1, a mechanical watch movement in accordance with the invention comprises, on a bottom plate 1, a barrel, a going train, an escapement, a regulation device (not shown) and a time-display gear train 2 rotationally driving indicating hands above a dial 3. The time-display gear train 2 comprises a cannon pinion 4, a cannon pinion-mounted wheel 5, a motion work wheel and pinion 6, 7, a 24 hour wheel and pinion 8, 9, a differential gear 10 and a 12 hour wheel and pinion 11, 12. The cannon pinion 4 bears a hand indicating the minutes making one revolution every hour. The cannon pinion-mounted wheel 5 is friction-mounted on the cannon pinion 4 and is driven by the third pinion of the going train, designated in FIG. 2 by the reference numeral 5*a*. The cannon pinion 4 drives the motion work wheel 6 which drives, via the motion work pinion 7 which is fixed relative thereto, the 24 hour wheel 8. The 24 hour wheel 8 is fixedly mounted on a tube or pipe 13 freely surrounding the cannon pinion 4. The tube 13 defines the 24 hour pinion 9 and bears a first hand indicating the hours, referred to as the 24 hour hand, making one revolution every 24 hours. Via the differential gear 10, the 24 hour pinion 9 drives a mobile part comprising the 12 hour pinion 12, the 12 hour wheel 11 and a central tube 14 all fixed relative to each other. The tube 14 freely surrounds the tube 13 and bears a further hand indicating the hours, referred to as the 12 hour hand, making one revolution every 12 hours.

The differential gear 10 comprises a planet carrier 15 freely mounted around the tube 13 and comprising teeth 16 on its periphery, and a planetary mobile part pivotably mounted around an eccentric pin 17 fixed to the planet carrier 15. The planetary mobile part comprises a pinion 18 which engages with the 24 hour pinion 9 and a wheel 19 which is fixed relative to the pinion 18 and which engages with the 12 hour pinion 12.

Figure 2:
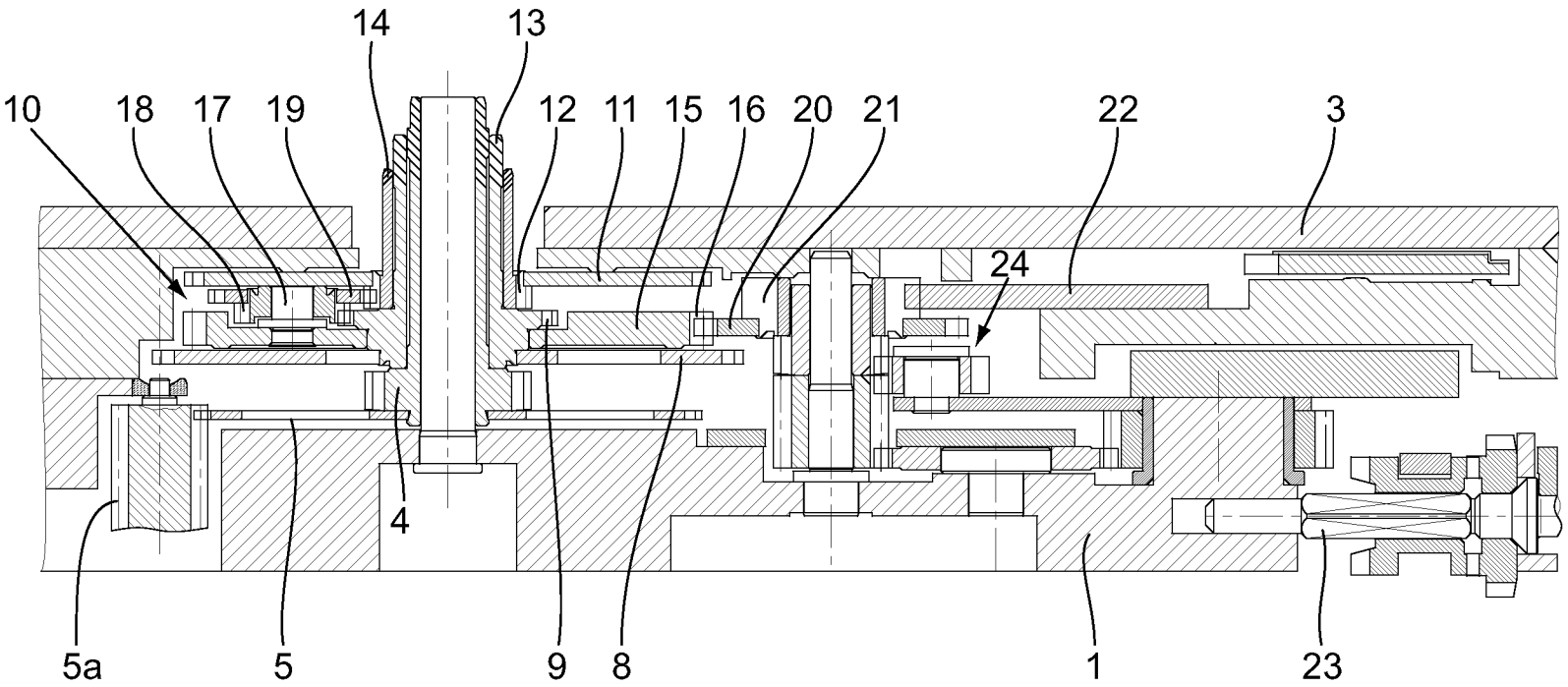
FIG. 2 is a cross-sectional view taken along another broken line of said part of the timepiece movement in accordance with the invention.

During normal operation, the planet carrier 15 is prevented from rotating and the differential gear 10 is used only as a gear reducer for driving the 12 hour pinion 12 from the 24 hour pinion 9. As can be seen in FIG. 2, the teeth 16 of the planet carrier 15 are engaged with a wheel 20 which is coaxial and fixed relative to a star 21 acted upon by a positioning jumper 22. The wheel 20 can be actuated by a winding rod 23 of the movement via a gear train 24 when the winding rod 23 is in an intermediate axial position between the winding position and the hand-setting position. Thus, by turning the winding rod 23 when it is in this intermediate axial position, the planet carrier 15 can be displaced step-by-step to correct the angular position of the 12 hour hand without modifying the angular position of the 24 hour hand.

Traditionally, hand-setting can be effected by turning the winding rod 23 when it is in its axial hand-setting position. The rotation of the winding rod 23 actuates the motion work wheel 6 via a gear train (not shown), thereby simultaneously rotating the minute hand, the 12 hour hand and the 24 hour hand.

Figure 3:
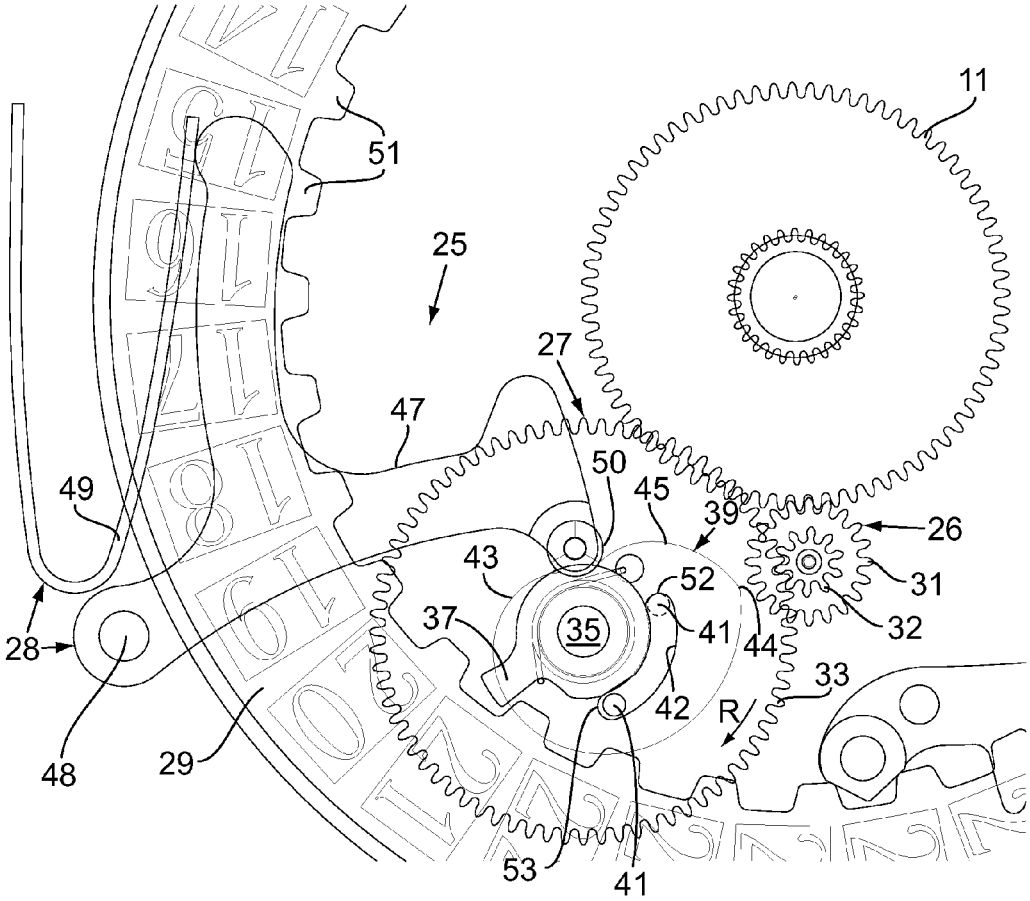
FIG. 3 is a partial top view of a date-display mechanism provided in the timepiece movement in accordance with the invention, in which the components of the mechanism are shown transparently.

The movement in accordance with the invention also comprises a date-display mechanism 25 which can be seen in FIGS. 1 and 3. This mechanism 25 comprises an intermediate mobile part 26, a drive mobile part 27, an actuating member 28 and an indicating disk 29 bearing the numbers 1 to 31 of the days of the month successively visible through an aperture 30 formed in the dial 3.

The intermediate mobile part 26 is driven by the 12 hour wheel 11 and comprises a wheel 31 and a pinion 32 fixed relative to each other. The wheel 31 engages with the 12 hour wheel 11 and the pinion 32 engages with a wheel 33 of the drive mobile part 27 to drive this wheel 33 at the rate of one revolution every 24 hours.

The drive mobile part 27 further comprises a hub 34 mounted so as to freely rotate about a fixed shaft 35, i.e., a shaft that is rotationally fixed with respect to the bottom plate 1. At one axial end 36 of the hub 34 there extends radially a drive finger 37 which is fixed relative to the hub 34 and is preferably formed in one piece therewith. Around the other axial end 38 of the hub 34 there is fixedly attached an instantaneous jump cam 39. The wheel 33 is freely mounted around the hub 34 between the cam 39 and an assembling piece 40 fixedly attached to the hub 34. However, the wheel 33 is connected to the cam 39 so as to be able to be rotationally displaced with respect thereto only by a predetermined angle. To this end, an eccentric pin 41 driven into the cam 39 passes into an oblong opening 42 formed in the wheel 33 and having the form of a circular arc centred on the axis of the wheel 33 (cf. FIG. 3).

Figure 4:
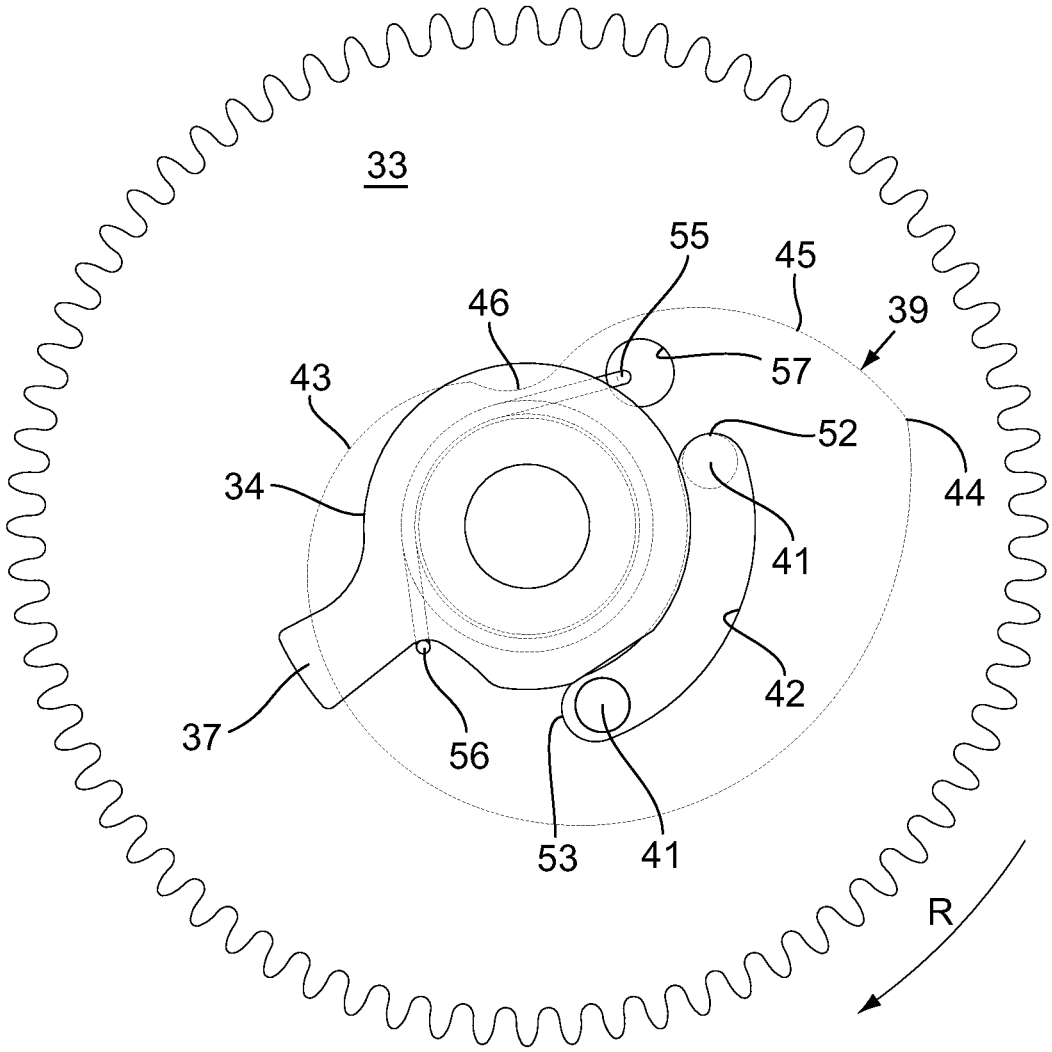
FIG. 4 is a top view of a drive mobile part forming part of the date-display mechanism shown in FIG. 3.

As shown in FIGS. 3 and 4, the cam 39 comprises a first part 43 in the form of a spiral portion extending away from the centre of the cam 39 up to a tip 44, a second convex part 45 extending from the tip 44 towards the centre of the cam 39 and a third part 46 in the form of a recess. The actuating member 28 comprises a lever 47 pivoting about a point 48 and a spring 49 biasing and permanently keeping the lever 47 against the cam 39. The lever 47 co-operates with the cam 39 via a roller 50.

The date indicator disk 29 comprises inner teeth 51 co-operating with the drive finger 37. Owing to the continuous rotation of the wheel 33 at a rate of one revolution every 24 hours under the action of the time-display gear train 2 exerted via the mobile part 26, the drive finger 37 contacts once per day, at midnight, a tooth of the teeth 51 to drive the date indicator disk 29 by one step. Each revolution of the wheel 33 is broken down into a sequence of three phases, namely:

- a first phase, typically of about 18 hours, during which the pin 41 is located at one end 52 of the oblong opening 42, as shown by the dotted lines in FIGS. 3 and 4, and is pushed by the wall of this opening 42, thus rotationally driving the cam 39 in a fixed manner relative to the wheel 33 in the direction shown by the arrow R and causing the roller 50 to roll on the first part 43 of the cam 39; during this phase the lever 47 is raised by the first part 43 of the cam 39, thus cocking the spring 49;
- a second phase starting as soon as the roller 50 passes the tip 44 of the cam 39, during which the spring 49—released from the action exerted by the first cam part 43—relaxes which causes the lever 47 to fall, which lever, in co-operation with the second cam part 45, sharply displaces the cam 39 in the direction of rotation R of the wheel 33, allowing the drive finger 37 fixed relative to the cam 39 to displace the indicator disk 29 by one step; during this phase, called "instantaneous" since it is extremely rapid, the pin 41 is displaced in the oblong opening 42 towards the other end 53 of the latter without driving the wheel 33; at the end of this second phase, the roller 50 comes to be housed in the recess 46 of the cam 39, thus preventing the cam 39 from rotating; it is this position which is shown in FIGS. 3 and 4, with the pin 41 illustrated in solid lines;
- a third phase, typically of about 6 hours, during which the wheel 33—still rotating in its direction of rotation R—progressively catches up with the angular position of the cam 39 until the end 52 of the opening 42 comes to contact the pin 41, this contact representing the start of the first phase of the following revolution of the wheel 33.

During the first phase, the lever 47 exerts a return torque on the cam 39 and thus on the wheel 33 (owing to the co-operation between the pin 41 and the end 52 of the opening 42), i.e., a torque tending to rotate the wheel 33 and the cam 39 in the direction opposite the direction R. This return torque propagates up to the gear between the cannon pinion-mounted wheel 5 and the third pinion 5*a* and thus compensates all the backlash of the time-display gear train 2, the backlash of the going tram having already been compensated by the tension exerted by the barrel. Therefore, in the case of shock, hand-setting or correction of the angular position of the 12 hour hand, the hands will not become offset with respect to each other, or will only become offset to a small degree, whilst the lever 47 will remain bearing against the first cam part 43 regardless of the direction of hand-setting or correction. In the case of hand-setting or correction in the clockwise direction, in fact, the 12 hour wheel 11 drives the drive mobile part 27 in the direction R via the mobile part 26 and the lever 47 bearing against the first cam part 43 exerts a return torque compensating the backlash in the same manner as described above. In the case of hand-setting or correction in the anti-clockwise direction, the action of the lever 47 on the first cam part 43 displaces the wheel 33 in the direction opposite the direction R and this movement of the wheel 33 is retained and controlled by the motion work mobile part 6, 7 (in the case of hand-setting) or by the third pinion 5*a* (in the case of correction) rotating in the direction opposite its normal direction.

During the third phase of a normal revolution of the wheel 33, the lever 47 no longer exerts a return torque, so that if no backlash-compensating device is provided, as in the Prior Art, the backlash will not be compensated. A differential gear such as the gear 10 illustrated in FIG. 1 significantly increases the backlash. If hand-setting is effected by rotating the hands in the anti-clockwise direction, or if correction of the angular position of the 12 hour hand is effected in the anti-clockwise direction, then the backlash accumulates and a large offset between the 12 hour hand and the 24 hour hand can appear, just like between each of these hands and the minute hand. Such offsets could also appear in the case of shock received by the watch.

To obviate or reduce this problem, a return spring 54 is disposed around the hub 34 and its ends are fixed respectively to the wheel 33 and to the hub 34 relative to which the cam 39 is fixed. In the illustrated embodiment, the spring 54 is a coil spring and its ends are fixed to the wheel 33 and to the hub 34 via hooks 55, 56 (cf. FIGS. 1 and 4). For example, the hook 55 hooks into an opening 57 provided in the wheel 33 whilst the hook 56 hooks into the junction between the hub 34 and the drive finger 37. However, in alternative embodiments, the spring 54 could be fixed to the wheel 33 and to the hub 34 in a different manner.

During the first phase of a revolution of the wheel 33 described above, the spring 54 is torsionally tightened and tends to bring the pin 41 and the end 53 of the opening 42 closer together but the action of the lever 47 on the first part 43 of the cam 39 is greater than the action of the spring 54 such that the pin 41 remains bearing against the end 52 of the opening 42 allowing the wheel 33 to drive the cam 39. During the second phase, the spring 54 relaxes and thus acts in the same direction as the lever 47, which facilitates the instantaneous jump of the cam 39. During the third phase, where the cam 39 is held fixed relative to the bottom plate 1 by the lever 47, the spring 54 tightens as the wheel 33 advances and thus exerts on the latter a return torque which suppresses the backlash in the time-display gear train 2 similarly to the action of the lever 47 during the first phase. Preferably, the spring 54 is prestressed so that it begins to exert the said return torque as soon as the third phase begins, just after the instantaneous jump.

The spring 54 could be another type of spring than a coil spring. For example, it could be a shaped spring in which the lug would be fixed, e.g., riveted, to the wheel 33 and the end of its leaf would be fixed, e.g., hooked, to the pin 41, or a spiral spring the inner part of which would be fixed around an axial annular protrusion of the wheel 33 and the outer part of which would be fixed to the pin 41. In another alternative embodiment, the spring 54, e.g., a leaf spring like the spring 49, could be fixed to the wheel 33 and could act on a lever which is itself pivoted on the wheel 33 and acts on a second cam fixed relative to the cam 39. The second cam would thus act to tighten the spring fixed to the wheel 33 during the third phase, similarly to the action of the first part 43 of the cam 39 during the first phase.

Nevertheless, the use of a coil spring is preferred in the present invention. In fact, it is important to reduce as much as possible the difference in return torque between the start and end of the third phase so that the return torque of the spring is sufficiently large without the torque required to re-cock the spring being too high. To achieve this, the active length of the spring must be as long as possible. A coil spring has a long active length. Moreover, a coil spring is naturally guided by the piece around which it is mounted, in this case the hub 34. No additional element is required to guide it.

In alternative embodiments of the invention, the drive finger 37 could be not fixed relative to the cam 39 but driven by the pin 41, as is known per se.

Although it is particularly advantageous in the context of a movement comprising a differential gear, where there can be a great deal of backlash, the present invention is not limited to such an application, nor to an application where several hour hands are provided.

It will also be noted that the assembly formed by the intermediate mobile part 26, the wheel 33, the cam 39, the pin 41, the actuating member 28 and the spring 54 represents a backlash-compensating mechanism which could be used without being associated with a drive finger and with an indicator, which could both be omitted or driven by another mechanism of the movement. Said assembly could thus be used solely to tighten the time-display gear train 2 or another gear train to suppress the backlash.

The invention claimed is:

1. Backlash-compensating mechanism for a timepiece movement, comprising a cam (39), an actuating member (28) bearing against the cam (39) and a wheel (33) coaxial to the cam (39) and intended to be driven by a gear train (2) of the movement, the cam (39) and the wheel (33) being connected to each other such that one revolution of the wheel (33) comprises a sequence of a first phase in which the wheel (33) drives the cam (39) whilst the co-operation between the cam (39) and the actuating member (28) cocks the latter, a second phase in which the actuating member (28) uncocks and causes the cam (39) to effect an instantaneous jump, and a third phase in which the cam (39) is immobilised and the wheel (33) continues to advance until it catches up with the cam (39) to once again drive it during the first phase of the following revolution, characterised in that it further comprises resilient means (54) acting between the cam (39) and the wheel (33) and applying a return torque to the wheel (33) during the third phase.

2. Backlash-compensating mechanism as claimed in claim 1, characterised in that the resilient means (54) comprise a spring whose ends are fixed relative to the cam (39) and to the wheel (33) respectively.

3. Backlash-compensating mechanism as claimed in claim 2, characterised in that the spring (54) is a coil spring coaxial to the cam (39) and to the wheel (33).

4. Backlash-compensating mechanism as claimed in claim 3, characterised in that it comprises a hub (34) around which the wheel (33) is mounted and relative to which the cam (39) is fixed, and in that the spring (54) is located around the hub (34) and has its ends fixed to the hub (34) and to the wheel (33) respectively.

5. Backlash-compensating mechanism as claimed in claim 2, characterised in that at least one of the ends of the spring (54) is made fixed relative to the cam (39), respectively to the wheel (33), by a hook (56, 55).

6. Backlash-compensating mechanism as claimed in claim 1, characterised in that the cam (39) and the wheel (33) are connected by an eccentric pin (41) fixed to the cam (39) and co-operating with an oblong opening (42) formed in the wheel (33) and in the form of a circular arc centred on the axis of the wheel (33).

7. Backlash-compensating mechanism as claimed in claim 1, characterised in that the actuating member (28) comprises a lever (47) and a spring (49) biasing the lever (47) against the cam (39).

8. Instantaneous jump display mechanism comprising a backlash-compensating mechanism as claimed in claim 1, a drive member (37) driven by the cam (39) of the backlash-compensating mechanism and an indicator (29) driven by the drive member (37).

9. Instantaneous jump display mechanism as claimed in claim 8, characterised in that the drive member (37) is fixed relative to the cam (39).

10. Instantaneous jump display mechanism as claimed in claim 9, characterised in that the resilient means (54) comprise a coil spring whose ends are fixed relative to the cam (39) and to the wheel (33) respectively, the coil spring being coaxial to the cam (39) and to the wheel (33), the backlash-compensating mechanism further comprising a hub (34) around which the wheel (33) is mounted and relative to which the cam (39) is fixed, the coil spring (54) being located around the hub (34) and having its ends fixed to the hub (34) and to the wheel (33) respectively, and the drive member (37) radially protruding from the hub (34).

11. Instantaneous jump display mechanism as claimed in claim 8, characterised in that the indicator (29) is a date indicator.

12. Timepiece movement comprising an instantaneous jump display mechanism as claimed in claim 8.

13. Timepiece movement comprising a backlash-compensating mechanism as claimed in claim 1.

14. Timepiece movement as claimed in claim 13, characterised in that it comprises a time-display gear train (2) which drives the backlash-compensating mechanism, and in that this time-display gear train (2) comprises a differential gear (10) connecting a mobile part (8, 9) having a first hand indicating the hours to another mobile part (11, 12) having another hand indicating the hours.

15. Watch comprising a timepiece movement as claimed in claim 14.

16. Watch comprising a timepiece movement as claimed in claim 13.

* * * * *